US007676929B2

(12) United States Patent
Lembke et al.

(10) Patent No.: US 7,676,929 B2
(45) **Date of Patent: *Mar. 16, 2010**

(54) RAZOR BLADE PLATFORM AND RAZOR CARTRIDGE USING SAME

(75) Inventors: Max Arthur Lembke, Perivale (GB); Jochen Thoene, Wuppertal (DE); Stephan Fischer, Gevelsberg (DE); Henryk Bykowski, Solingen (DE)

(73) Assignee: Eveready Battery Company Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/787,610

(22) Filed: Apr. 16, 2007

(65) Prior Publication Data

US 2007/0256303 A1 Nov. 8, 2007

Related U.S. Application Data

(62) Division of application No. 10/765,549, filed on Jan. 27, 2004, now abandoned.

(60) Provisional application No. 60/442,990, filed on Jan. 28, 2003.

(51) Int. Cl.
*B26B 21/22* (2006.01)

(52) U.S. Cl. ..... 30/50; 30/58; 30/346.57

(58) Field of Classification Search ..... 30/50, 30/47, 49, 41.5, 346.57, 54, 57, 58; 968/654
See application file for complete search history.

(56) References Cited

U.S. PATENT DOCUMENTS

| | | | | |
|---|---|---|---|---|
| 4,200,976 | A * | 5/1980 | Gooding | 30/47 |
| 5,666,729 | A * | 9/1997 | Ferraro | 30/50 |
| 6,112,412 | A * | 9/2000 | Richard | 30/41.5 |
| 6,772,523 | B1 * | 8/2004 | Richard et al. | 30/527 |
| 6,948,249 | B2 * | 9/2005 | Barone et al. | 30/41 |
| 2001/0023539 | A1 * | 9/2001 | Kwiecien et al. | 30/50 |
| 2002/0157259 | A1 * | 10/2002 | Coffin | 30/50 |
| 2003/0213130 | A1 * | 11/2003 | Motta | 30/50 |
| 2003/0217469 | A1 * | 11/2003 | Coffin | 30/50 |
| 2004/0128835 | A1 * | 7/2004 | Coffin et al. | 30/50 |
| 2004/0177511 | A1 * | 9/2004 | Miyazaki et al. | 30/50 |
| 2004/0181949 | A1 * | 9/2004 | Coffin et al. | 30/346.57 |
| 2004/0221455 | A1 * | 11/2004 | Coffin | 30/50 |
| 2004/0231161 | A1 * | 11/2004 | Coffin et al. | 30/50 |
| 2004/0261271 | A1 * | 12/2004 | Coffin et al. | 30/50 |
| 2006/0032056 | A1 * | 2/2006 | Coffin et al. | 30/50 |
| 2006/0277769 | A1 * | 12/2006 | Coffin et al. | 30/527 |

FOREIGN PATENT DOCUMENTS

| | | |
|---|---|---|
| JP | 2000-308770 | 11/2000 |
| JP | 2002-325985 | 11/2002 |
| WO | 01/39937 A1 | 6/2001 |

* cited by examiner

*Primary Examiner*—Kenneth E. Peterson
*Assistant Examiner*—Sean Michalski
(74) *Attorney, Agent, or Firm*—Energizer Personal Care

(57) ABSTRACT

The present invention is a razor blade carrier having a base with at least two stepped protrusion extending outwardly therefrom. The stepped protrusion define at least two landing positions that support a portion of the razor blade. The landing surfaces of the stepped protrusions cooperate to define at least two razor blade locations. The razor blade carrier is used in a razor cartridge.

10 Claims, 4 Drawing Sheets

RAZOR BLADE PLATFORM AND RAZOR CARTRIDGE USING SAME

CROSS-REFERENCE TO RELATED APPLICATIONS

This application is a division of U.S. patent application Ser. No. 10/765,549, filed Jan. 27, 2004, the contents of which are incorporated herein in their entirety, and which application is entitled to the benefit of and incorporates by reference essential subject matter disclosed in Provisional Patent Application No. 60/442,990 filed on Jan. 28, 2003.

FIELD OF THE INVENTION

The invention relates generally to shaving implements for use on hirsute surfaces and more specifically to a device for supporting razor blades forming part of a razor cartridge.

BACKGROUND OF THE INVENTION

Modern safety razors typically include a razor cartridge that supports at least one razor blade for removing hair from hirsute surfaces during a shaving operation. These razor cartridges typically incorporate two or more razor blades to allow for greater hair removal in a single pass of the razor.

The positioning of multiple razor blades within a small, often disposable razor cartridge, can be complex. For example, to ensure an acceptably close shave and to minimize the potential for cutting, abrading, or nicking the skin, or uncomfortably pulling the hair during a shaving operation the orientation of the razor blades in a multi-blade razor cartridge important. A problem associated with prior art razor cartridges concerns the difficulties associated with establishing and maintaining a desired blade alignment and orientation. This is due in part to the fact that the razor cartridge consists of a multiplicity of parts including spacers. Each of these parts has associated with it an acceptable tolerance range. When assembled these tolerance ranges can sometimes become additive thereby resulting in a less than desirable alignment of the razor blades. In addition, due to the miniature nature of the parts that comprise the razor cartridge, difficulties in assembly can further misorient components. As a result of the multiple parts, manufacturing is expensive with quality control being problematic.

In addition, the multiple parts cause undesirable blockages within the razor cartridge. In a wet shaving operation wherein a shaving aid, such as a cream or gel is employed, debris, such as hair and shaving cream, may become lodged within the multi- blade razor cartridge between the razor blades. The debris is customarily removed from the multi-blade razor cartridge by flushing with water, however, blockages due to the positioning of features and components in the cartridge can make removal of the debris difficult or impossible. In extreme cases, blockages can cause a buildup of debris within the cartridge that alters the spacing between the blades or causes the development of surfaces that prevent the skin from properly engaging the blades leading to a shaving outcome that is less than optimum.

Based on the foregoing, it is an object of the present invention to improve upon or overcome the problems associated with prior art razors and cartridges.

SUMMARY OF THE INVENTION

The present invention is directed in one aspect to a razor blade platform that includes a base portion having at least two projections extending therefrom. Each projection defines at least a pair of approximately parallel spaced apart support surfaces. Each of the support surfaces on one of the projections is approximately laterally aligned with a corresponding support surface defined by the other projection and is adapted to carry a portion of a razor blade.

In an embodiment of the present invention, the razor blade platform includes a plurality of projections, a portion of which define slots that are open at one end with one of the above-described support surfaces partially defining each slot. A portion of a razor blade to be mounted onto the blade platform, is slidably received within each slot and engages an abutment surface forming part of the slot portion of a rear edge defined by each razor blade to be mounted to the blade thereby ensuring proper alignment of the razor blade relative to the blade platform. Preferably, the blade platform is formed from a single piece of polymeric material and defines at least one aperture extending therethrough to allow shaving debris to be washed from the blade platform.

The present invention also resides in a second aspect to a razor cartridge that includes a first cover that defines an opening and is adapted to overlie the above-described razor blade platform. The razor blade platform has at least two razor blades mounted thereon so that at least a portion of the cutting edges of the razor blades is positioned within the first cover opening and thereby exposed. A second cover is coupled to the first cover and together they cooperate to define an interior area in which the blade platform is located.

In one embodiment, a thin wire is wrapped around the razor cartridge and over the opening defined by the first cover. The wrapped wire extends across the opening transversely of the cutting edges to minimize the potential for skin to extrude between the razor blades during a shaving operation. In addition, the second cover preferably defines an aperture that cooperates with any apertures or passages in the blade platform to allow shaving debris to be washed from the razor cartridge.

The present invention resides in yet another aspect, in a method for loading razor blades into a blade platform for use in a razor cartridge.

Initially, a blade platform is provided that defines at least two support surfaces each adapted to carry a portion of a razor blade. A blade support is also provided and defines at least two mating support surfaces positioned to be approximately coincident with the support surfaces defined by the blade platform when the blade platform and the blade support are moved into proximity with one another. The blade support also includes means for releasably retaining at least two razor blades thereon. At least two razor blades are releasably mounted to the blade support which is then moved into proximity with the blade platform so that a portion of the razor blades engage the support surfaces defined by the blade platform. The razor blades are then adhered to the blade platform and at least one of the blade support and the blade platform is moved away from the other of the blade support and the blade platform so that the razor blades remain adhered to the blade platform.

In another embodiment of the method of the present invention, the razor blades are mounted onto a retainer so that they can be rotatably, or angularly, moved into position on the razor blade platform.

DETAILED DESCRIPTION OF THE PREFERRED EMBODIMENTS

Figure 1:
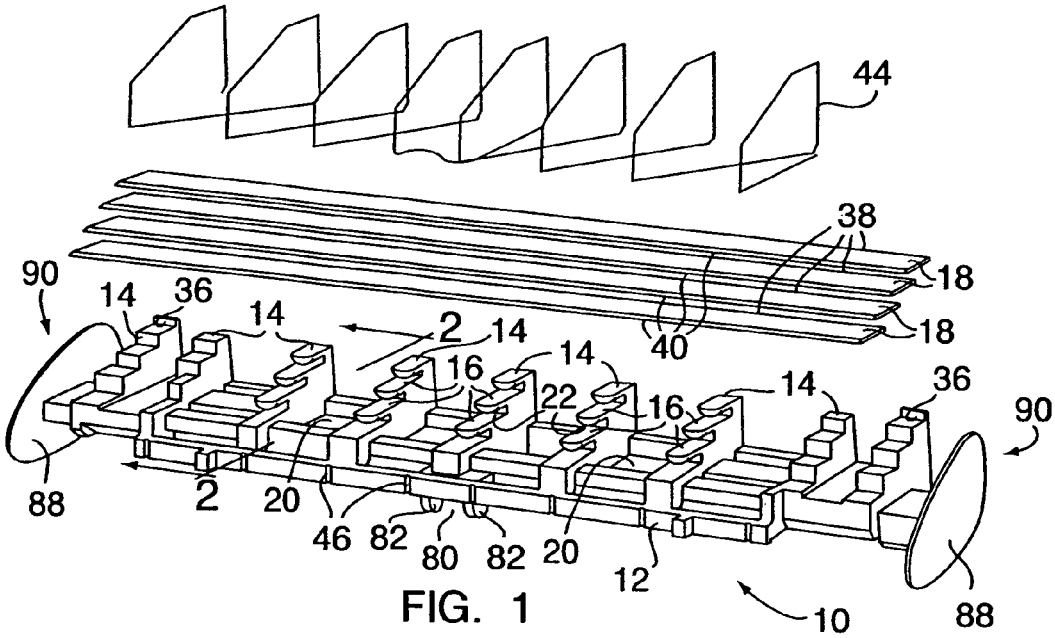
FIG. 1 is an exploded perspective view illustrating a razor blade platform of the present invention along with razor blades and a wire wrap to be supported by the razor blade platform.

As shown in FIG. 1, a razor blade platform embodying the present invention and generally denoted by the reference number 10, includes a base portion 12 having a plurality of projections 14 extending outwardly therefrom. Each projection 14 defines at least a pair of spaced apart, and in the illustrated embodiment, stepped, support surfaces 16. Each projection 14 has four approximately parallel support surfaces 16. Each support surface 16 on one of the projections 14 being approximately laterally aligned with a corresponding support surface on the next successive projection. Each of the support surfaces 16 is adapted to support a portion of a razor blade 18, so that the razor blade extends across, and is carried by the approximately laterally aligned support surfaces. As shown in FIG. 1, the razor blade platform 10 is adapted to carry four razor blades 18. However, the present invention is not limited in this regard as the razor blade platform 10 can be configure to carry more than, or less than four razor blades 18.

In the preferred embodiment of the present invention, the razor blade platform 10 is formed from, or into a single piece of, preferably polymeric, material. The razor blade platform 10 can also be made by injection molding. However, the present invention is not limited in this regard as the razor blade platform can be made from different materials, such as metals or elastomers.

The base portion 12 has passages 20 therein to allow for the removal of debris, such as skin, hair, and shaving aid, that can become lodged between the razor blades 18 and/or between the razor blades 18 and the base portion 12 during a shaving operation.

Figure 3:
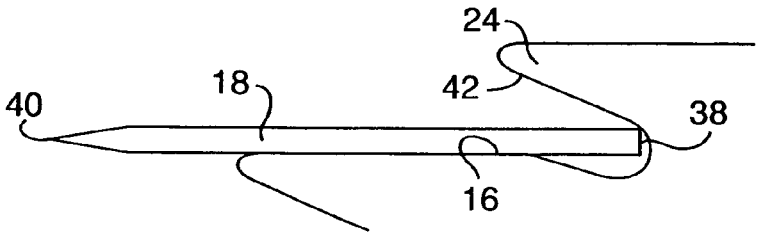
FIG. 3 is a partial sectional view of an alternative embodiment of the razor blade platform of FIG. 1 taken along line 2-2.
Figure 4:
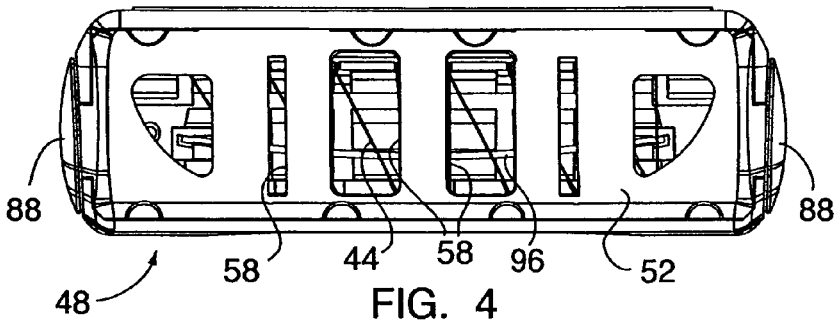
FIG. 4 is a bottom view of a razor cartridge that employs the razor blade platform of FIG. 1.
Figure 5:
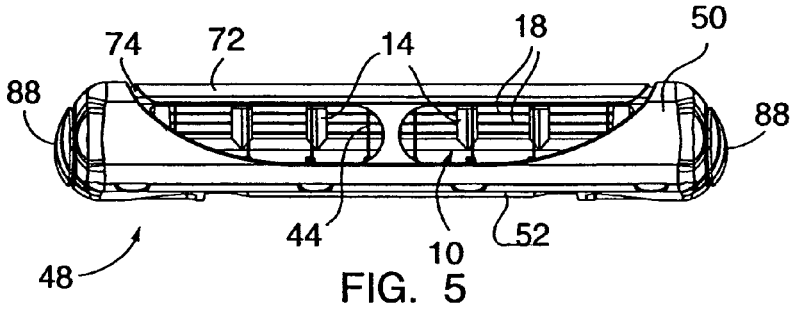
FIG. 5 is a rear view of a razor cartridge employing the razor blade platform of FIG. 1.
Figure 6:
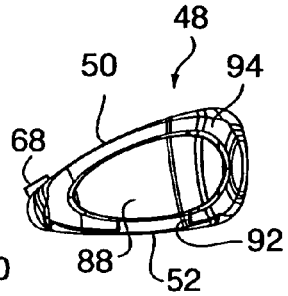
FIG. 6 is a side view of a razor cartridge employing the razor blade platform of FIG. 1.
Figure 7:
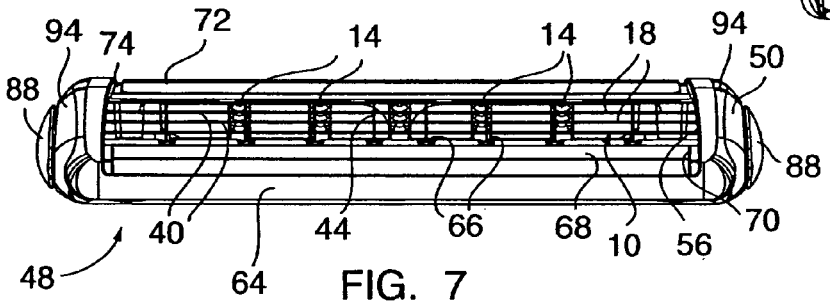
FIG. 7 is a front view of a razor cartridge employing the razor blade platform of FIG. 1.
Figure 8:
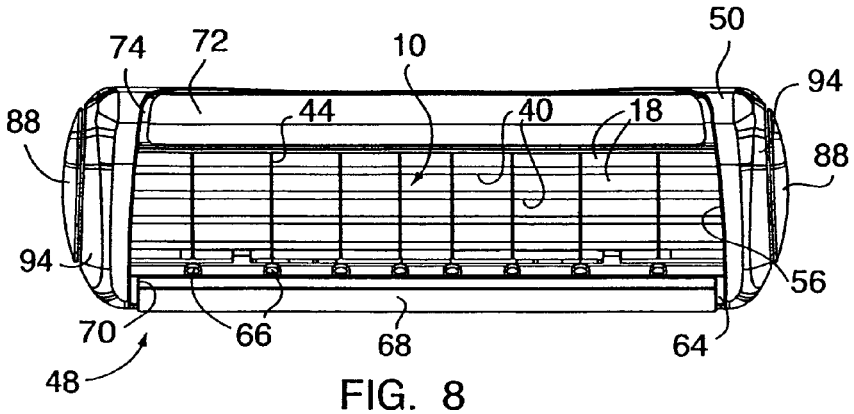
FIG. 8 is a top view of a razor cartridge employing the razor blade platform of FIG. 1.
Figure 9:
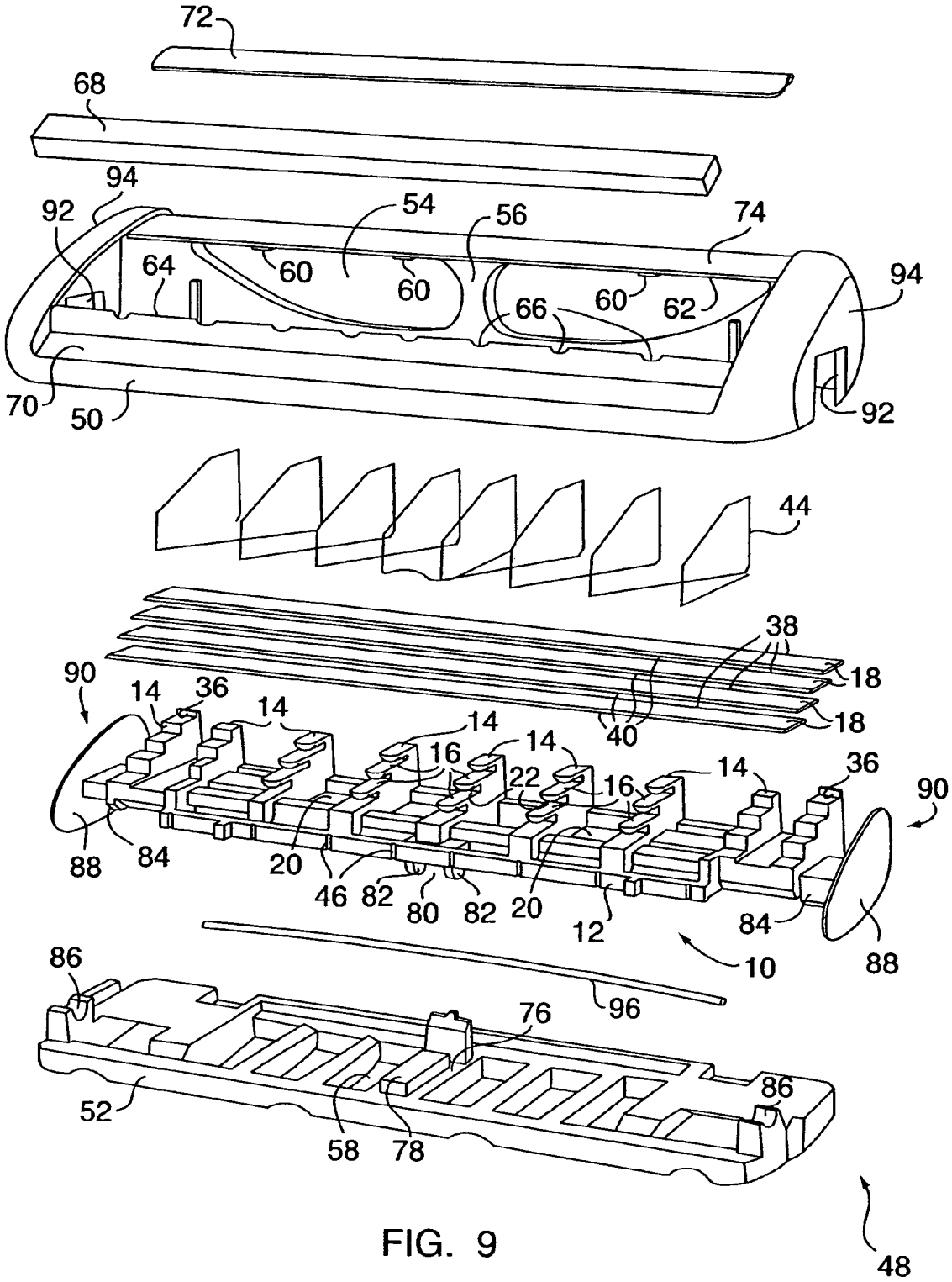
FIG. 9 is an exploded perspective view of a razor cartridge employing the razor blade platform of FIG. 1.

There may be any number of support surfaces 16 on a projection 14. These support surfaces 16 can be equally spaced or not. In some cases, some of the support surfaces 16 could be equally spaced and others not. In addition, the area defined by each of the support surfaces 16 may vary. The support surfaces 16 are not necessarily planar and may be undulating or have troughs, such an embodiment is illustrated in FIG. 3.

Figure 2:
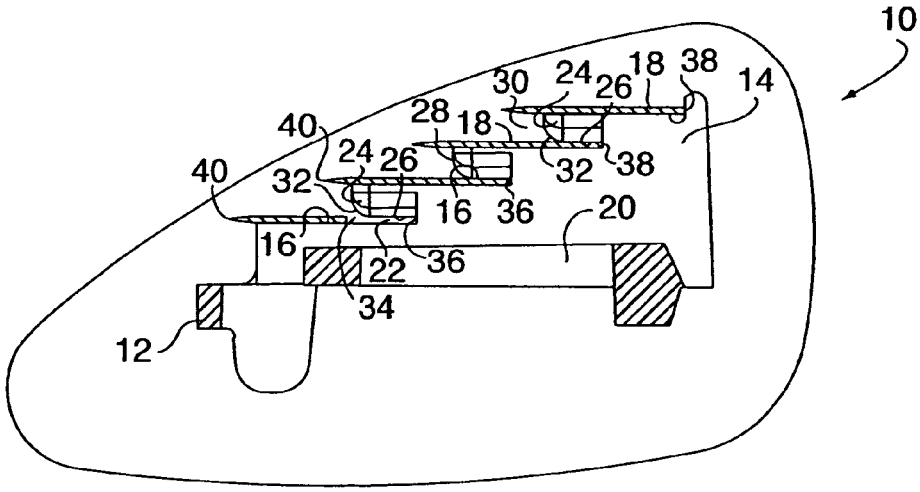
FIG. 2 is a cross sectional view of the razor blade platform of FIG. 1 taken along line 2-2.

Referring to FIG. 2, a portion of the plurality of projections 14 include slots 22, open at one end and defined in-part by one of the support surfaces 16. As shown, an overhanging portion 24, a surface of which defines a support surface 16 can also be established with a surface 26 generally opposite the support surface 16 acting to define in-part one of the slots 22. Depending upon the design of a shaving implement employing the razor blade platform 10, the overhang portion 24 can include a distal end 28 positioned such that skin does not extrude too far into an interstitial space 30 between the razor blades 18 during a shaving operation. The distal end 28 could also have, if desired, a chamfer 32 creating a larger opening 34 into the slot 22.

In addition to the above-described support surfaces 16, the projections 14 also define abutment surfaces 36 that provide for alignment of the razor blades 18 when positioned on the razor blade platform 10. Accordingly, when a razor blade 18 is mounted onto the razor blade platform 10, a surface 38 of the razor blade generally opposite the cutting edge 40, defined by the razor blade 18, engages the abutment surface 36, thereby aligning the razor blade relative to the razor blade platform 10.

Still referring to FIG. 2, the slot 22 can be of any shape. Depending upon the shape, the slot 22 could frictionally retain the razor blade 18 against the support surface 16. An alternative slot design is shown in FIG. 3. In this design, the overhang portion 24 has an undersurface 42 that is angled relative to the support surface 16 over which the overhang portion 24 projects such that the razor blade 18 is not held against the support surface 16 by the overhang portion 24.

Referring back to FIG. 1, a razor blade 18 is preferably attached to each laterally aligned support surface 16 of the razor blade platform 10. The support surfaces 16 provide the contour, if any, to the razor blade 18. In the preferred embodiment, the support surfaces 16 define a contour that is generally planar, but this should not be a limitation of the invention as any contour could be defined such as a fair curve but the contour could be unfair if desired. Attachment of the razor blade 18 to a support surface 16 can be by any Multiple configurations of the projection 14 are possible. In the embodiment depicted in FIG. 1, two configurations of the projections 14 are shown wherein some of the projections 14 define slots 22 while others do not. While a particular number of slotted and unslotted projections has been shown, the present invention is not limited in this regard as any number of projections and combinations of slotted and unslotted projections can be employed without departing from the broader aspects of the present invention.

A protective covering 44, shown in the illustrated embodiment as a thin length of wire is wrapped around the razor blade platform 10 and extends over the cutting edges 40 of the razor blades 18 mounted thereon. The wire 44 is provided to prevent a user's skin from excessively extruding between the razor blades 18. In order to properly orient the wire 44, relative to the razor blade platform 10, the wire 44, is positioned in slots 46 located in the base portion 12. However, the present invention is not limited in this regard as the wire 44 can be simply wrapped around the razor blade platform 10. Preferably, the wire 44 is metal, however other materials, such as, but not limited to, polymeric strands can be substituted without departing from the broader aspects of the present invention.

As shown in FIGS. 4 through 9, the razor blade platform 10 is integrated into a razor cartridge, generally designated by the reference number 48. The razor cartridge 48 has a first cover 50 that securely mates with a second cover 52. The first and second covers, 50 and 52 respectively, cooperate to define an interior area 54 into which the razor blade platform 10 is located. The first cover 50 has an opening 56 positioned relative to the razor blade platform 10 so that at least a portion of the cutting edges 46 of the razor blades 18 mounted on the razor blade platform 10 are exposed. In addition, the second cover 52 includes at least one opening 58 that cooperates with the passages 20 to allow debris accumulated during a shaving operation to be washed through the passages 20 and the opening 58 in the second cover 52.

The first cover 50 has protrusions 60 that extend outwardly from an interior surface 62. The protrusions 60 rest on one of the razor blades 18. The first cover 50 includes a leading edge 64 that defines recesses 66 that are aligned with the slots 46 on the razor blade platform 10. As stated above, the wire 44 engages the slots 46 as it is wrapped around the razor blade platform 10 and the razor blades 18 mounted thereon. The recesses 66 are sized based upon the size of the protective covering 44 such that there is a smooth transition for the skin from the leading edge 64 onto the protective covering 44.

The first cover 50 also includes a lubricious strip of material 68, preferably impregnated with a shaving aid. The lubricious strip 68 is positioned within a pocket 70 defined by the first cover 50 such that during a shaving operation, the user's skin engages the lubricious strip 68 prior to the skin engaging the cutting edge 40 of the razor blades 18. A second lubricious strip 72, also preferably impregnated with a shaving aid is located on an outer surface 74 of the first cover 50. Extending outwardly from an inner surface 76 of the second cover 52 is a tab 78 positioned to engage a slot 80 in the razor cartridge 48 defined by lobes 82 on the base portion 12 of the razor blade platform 10. The tabs 78 and slot 80 prevent longitudinal movement of the razor blade platform 10 relative to the first and second covers 50 and 52, respectively.

The razor blade platform 10 is mounted on the second cover 52 by placing opposed extensions 84 onto opposed bearing surfaces 86. In this embodiment, the extensions 84 are curved to match the contour of the bearing surfaces 86. This permits the razor blade platform 10 to roll in the second cover 52. A flange 88 on each distal end 90 of the extensions 84 further limit longitudinal movement of the razor blade platform 10.

The first cover 50 mates with the second cover 52 positioning the razor blade platform 10 within the razor cartridge 48. The first cover 50 has apertures 92 that are sized to permit the first cover to be positionable over the extensions 84. When assembled, the flanges 88 are located adjacent opposed outer surfaces 94 of the razor cartridge. A spring 96 is positioned in the interior area of the razor cartridge 48 between the second cover 52 and razor blade platform 10 to normally bias the razor blade platform 10 toward the first cover 50 and assist in positioning at least a portion of the cutting edges 40 within the opening 56.

Figure 10:
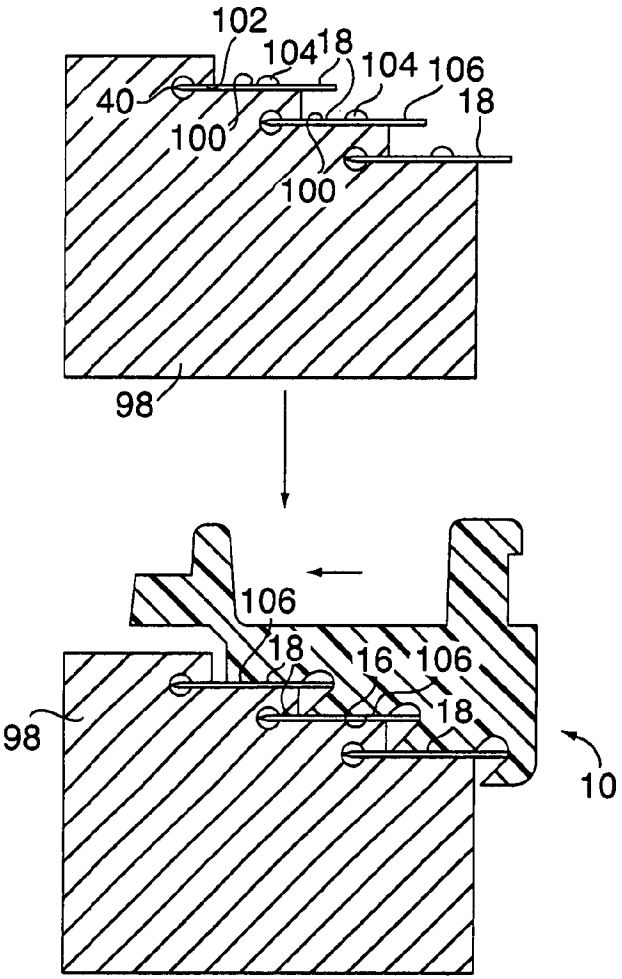
FIG. 10 schematically illustrates a method for mounting razor blades to a razor blade platform of the present invention.

The present invention also resides in a method for mounting the above-described razor blades 18 to the razor blade platform 10. As shown in FIG. 10, in an embodiment of the method, the razor blades 18 are mounted onto a blade support 98 defining support surfaces 100 oriented so as to be approximately coincident with the support surfaces 16 of the razor blade platform 10, when the blade support 98 and the razor blade platform 10 are brought into proximity with one another. The blade support 98 defines slots 102 adapted to releasable receive and retain at least a portion of the cutting edges 40 defined by the razor blades 18. Adhesive 104 is then applied to an outwardly facing surface 106 of each razor blade 18 releasably retained by the blade support 98. The adhesive 104 is applied on areal portions of each razor blade 18 that will engage the support surfaces 16 defined by the projection 14. The blade support 98 and the razor blade platform 10 are then brought into proximity with one another so that the outwardly facing surfaces 106 of the razor blades 18 engage the support surfaces 16 of the blade support 98. The adhesive 104 is then allowed to cure so that when the blade support 98 is moved away from the razor blade platform 10, the razor blades 18 release from the blade support 98 and remain bonded to the razor blade platform 10. While slots 102 on the blade support 98 have been shown and described as the mechanism by which the cutting edges 40 if the razor blade 18 are retained, the present invention is not limited in this regard as other manners of releasably retaining the razor blades 18 on the blade support 98 can be employed. For example, suction or clamps can be employed without departing from the broader aspects of the present invention.

Figure 11:
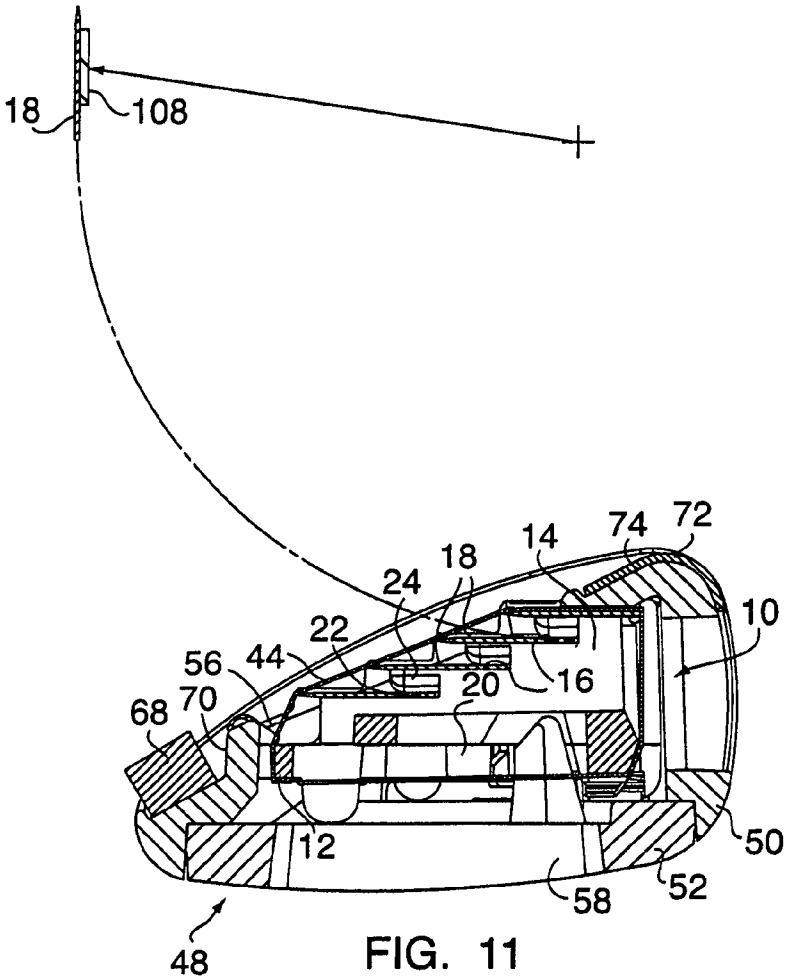
FIG. 11 schematically illustrates another embodiment of a method for mounting razor blades to a razor blade platform of the present invention.

In another method as shown schematically in FIG. 11, the razor blades 18 are each mounted to a retainer 108 and rotatably brought into engagement with the razor blade platform 10.

Although the present invention has been described in considerable detail with reference to certain preferred versions thereof, other versions are possible. Therefore, the spirit and scope of the invention should not be limited to the description of the preferred versions contained herein.

What is claimed is:

1. A razor cartridge comprising:

a first cover defining an interior area, the first cover having a first end surface and a second end surface;

a razor blade platform having:

a base portion;

at least two projections extending from said base portion each defining at least a pair of approximately parallel spaced apart support surfaces; each of said support surfaces on one of said projections being approximately laterally aligned with a corresponding one of said support surfaces defined by the other of said projections;

at least two razor blades, each being carried by at least two of said laterally aligned support surfaces; and two extensions that project outwardly from the base parallel to the blade edges and opposite side from each other, each extension having a distal end that terminates with a flange extending in a plane perpendicular to the extension;

wherein the razor blade platform, and the razor blades being carried on the razor blade platform, are within the interior area of the first cover, and are coupled to the first cover such that the extensions extend outward from the first and second end surfaces of the first cover and at least a portion of each first and second end surfaces are located between the flanges and wherein, when the first cover is adjacent the razor blade platform, said razor blade platform is coupled to said first cover such that said opening is positioned over said razor blades so that at least a portion of cutting edges defined thereby are exposed.

2. A razor cartridge as defined by claim 1 wherein said razor blade platform is unitary.

3. A razor cartridge as defined by claim 2 wherein said razor blade platform is a single molded piece of polymeric material.

4. A razor cartridge as defined by claim 1 further comprising a wire wrapped around said razor cartridge and extending over said portions of said cutting edged that are exposed, to minimize the tendency for skin to extrude between successive cutting edges during a shaving operation.

5. A razor cartridge as defined by claim 1 further comprising: a second cover coupled to said first cover; and wherein said razor blade platform is located between said first and second covers.

6. A razor cartridge as defined by claim 5, wherein said second cover defines at least one aperture to allow shaving debris to be washed therethrough during a shaving operation.

7. A razor cartridge as defined by claim 1 wherein: said projections are stepped and include an abutment surface extending between successive support surfaces; and wherein each of said razor blades define a rear surface approximately opposite and approximately parallel to said cutting edge; and said rear surface engages said abutment surface thereby aligning each razor blade relative to the next successive razor blade and to said blade platform.

8. A razor cartridge as defined by claim 1 wherein: each of said razor blades are adhered to at least one of said support surfaces.

9. A razor cartridge as defined by claim 1 wherein: said blade platform having said razor blades coupled thereto is movable relative to said first cover; and wherein said razor cartridge further includes biasing means for urging said blade platform toward said opening in response to an externally applied force.

10. A razor cartridge as defined by claim 9 wherein said biasing means is a spring in engagement with at least one of said first and second covers and in biasing communication with said blade platform.

* * * * *